US005839926A

United States Patent [19]

Kaye

[11] Patent Number: 5,839,926

[45] Date of Patent: Nov. 24, 1998

[54] AIRBOAT SYSTEMS AND METHODS FOR INCREASING ENGINE EFFICIENCY WHILE REDUCING TORQUE AND NOISE

[75] Inventor: Bruce Kaye, Inverness, Fla.

[73] Assignee: K-Way Engineering, Inc., Cocoa, Fla.

[21] Appl. No.: 910,074

[22] Filed: Aug. 12, 1997

Related U.S. Application Data

[63] Continuation of Ser. No. 50,911, Apr. 21, 1993, Pat. No. 5,807,149.

[51] Int. Cl.[6] ..... B63H 7/02

[52] U.S. Cl. ..... 440/37; 244/65; 416/170 R

[58] Field of Search ..... 244/53 R, 60, 244/62, 65, 69, 23 R, 12.1; 440/37, 75, 83, 84, 86; 416/170 R

[56] References Cited

U.S. PATENT DOCUMENTS 2,525,708 10/1950 Morris ..... 244/69

3,500,784 3/1970 Reynolds ..... 440/37

4,826,458 5/1989 Irwin et al. ..... 440/37

*Primary Examiner*—Galen L. Barefoot

*Attorney, Agent, or Firm*—Allen, Dyer, Doppelt, Milbrath & Gilchrist, P.A.

[57] ABSTRACT

An airboat propelling system is provided wherein a propeller is rotated by a hollow driven shaft. A further embodiment is provided wherein two propellers are rotated in opposite directions by counter-rotating coaxial hollow driven shafts. Floating stiffener bearings positioned between the coaxial hollow driven shafts suppress flexion and protect the opposing surfaces of the shafts. These innovative techniques permit a minimization of size and weight, as well as a reduction in rotational speed of the propellers, maximizing efficiency and decreasing noise.

15 Claims, 7 Drawing Sheets

AIRBOAT SYSTEMS AND METHODS FOR INCREASING ENGINE EFFICIENCY WHILE REDUCING TORQUE AND NOISE

This application is a continuation of U.S. patent application Ser. No. 08/050,911 filed on Apr. 21, 1993, now U.S. Pat. No. 5,807,149.

FIELD OF THE INVENTION

This invention generally relates to airboat systems and, particularly, to airboat propelling systems and methods for increasing efficiency while reducing torque and noise.

BACKGROUND OF THE INVENTION

Airboats are often driven over land and water at high speeds. Airboats typically employ aircraft engines operating at approximately 2500–3000 revolutions per minute (rpm) connected to solid direct-drive shafts, which rotate a single propeller. The steering apparatus usually comprises a pair of rudders, with trim tabs added to correct for the torque that results from the rotation of the propeller, this torque tending to keep the boat from maintaining a level attitude.

Extreme gyroscopic forces can occur when airboats are turned rapidly, and these forces are borne, among other structures, by the driven shaft.

Current airboat systems utilize belt-driven transmissions, which are inefficient owing to power losses caused by belt friction, especially at higher rotational velocities. Belt breakage in these systems is a source of failure. Another disadvantage of belt-driven systems is their inability to permit reduction of engine speed, since the shaft used to effect such a reduction would have to be too small to be practicable. Thus it would be advantageous to utilize a different transmission method in an airboat to enable engine speed reduction without loss of efficiency.

Propeller breakage is also a major source of failure, since at 3000 rpm extremely high forces are experienced at the propeller hub. It would therefore be desirable to reduce the load on the propeller.

It has been taught by Becker et al. (U.S. Pat. No. 4,932,280, dated Jun. 12, 1990) to use coaxial drive shaft systems for driving multiple outputs from a single input in an aircraft. Gearing means are disclosed for driving two outputs at different speeds.

A further concern in the airboat industry is noise pollution. Were it possible to increase efficiency and operate at reduced propeller speed, noise would be decreased.

SUMMARY OF THE INVENTION

One object of the invention is to provide an airboat having a hollow driven shaft of selected characteristics rotating a single propeller, in order to introduce a predetermined flexure into the system and avoid damage which might result from sharp turning movements. This shaft offers flexibility, strength, and decreased weight.

Another object of the invention is to provide a dual propeller system in an airboat with the propellers rotating in opposite directions and driven by coaxial shafts. This arrangement has many advantages, among which are:

(a) Noise reduction, since each propeller can turn at a significantly lower rotational rate to achieve the same speed as a single-propeller system;

(b) Elimination of torque, allowing the airboat to ride flat, since the counter-rotation of the two propellers yields a zero net angular force on the airboat;

(c) Increased efficiency, since the trim tabs on the rudders, which decrease thrust, can be eliminated, and since the distal propeller catches air turbulence "swirls" created by the proximal propeller and converts them to useful forward thrust; and (d) Increased durability and safety, since propeller breakage is greatly reduced, owing to the forces borne by them being cut in half.

A further object of the invention is to provide a transmission system necessary to drive the counter-rotating propellers. In the preferred form, two helical gear trains drive a pair of coaxial hollow driven shafts in opposite directions. A further improvement entails placing cylindrical floating stiffener bearings between the coaxial shafts to reduce whip in the shafts and to protect the opposing surfaces of the shafts. The further advantages gained by this combination of counter-rotator, coaxial hollow driven shafts and gear train are:

(e) Increased efficiency, since gear systems lose less to friction than do belt-driven units, and since weight is minimized by the optimization of the materials used in the construction of the shafts; and (f) Improved emissions properties, since the disclosed gear train unit permits the use of automotive engines, which have better overall performance, instead of the aircraft engines currently in use.

Another objective of the invention is to provide a lubricating system for the counter-rotator and coaxial shafts that enables smooth operation and increased durability. This lubrication system utilizes the longitudinal bores of the driven shafts, as well as features in the floating stiffener bearings, as parts of the oil circulation path, and also permits continuous lubrication of the gear trains.

BRIEF DESCRIPTION OF THE DRAWINGS

FIG. 7 is a cross-sectional view of the hollow driven shafts of FIGS. 3 and 4 with floating stiffener bearings, showing the path of lubricating oil by arrows.

DETAILED DESCRIPTION OF THE PREFERRED EMBODIMENTS

The preferred embodiments of an airboat design will be discussed with reference to FIGS. 1–10.

Airboat with Single Propeller and Hollow Driven Shaft

The first embodiment to be discussed entails an airboat with a single propeller mounted to a hollow driven shaft, in order to introduce a predetermined degree of flex to the airboat drive system, thereby avoiding equipment damage during certain extreme operating conditions.

Figure 1:
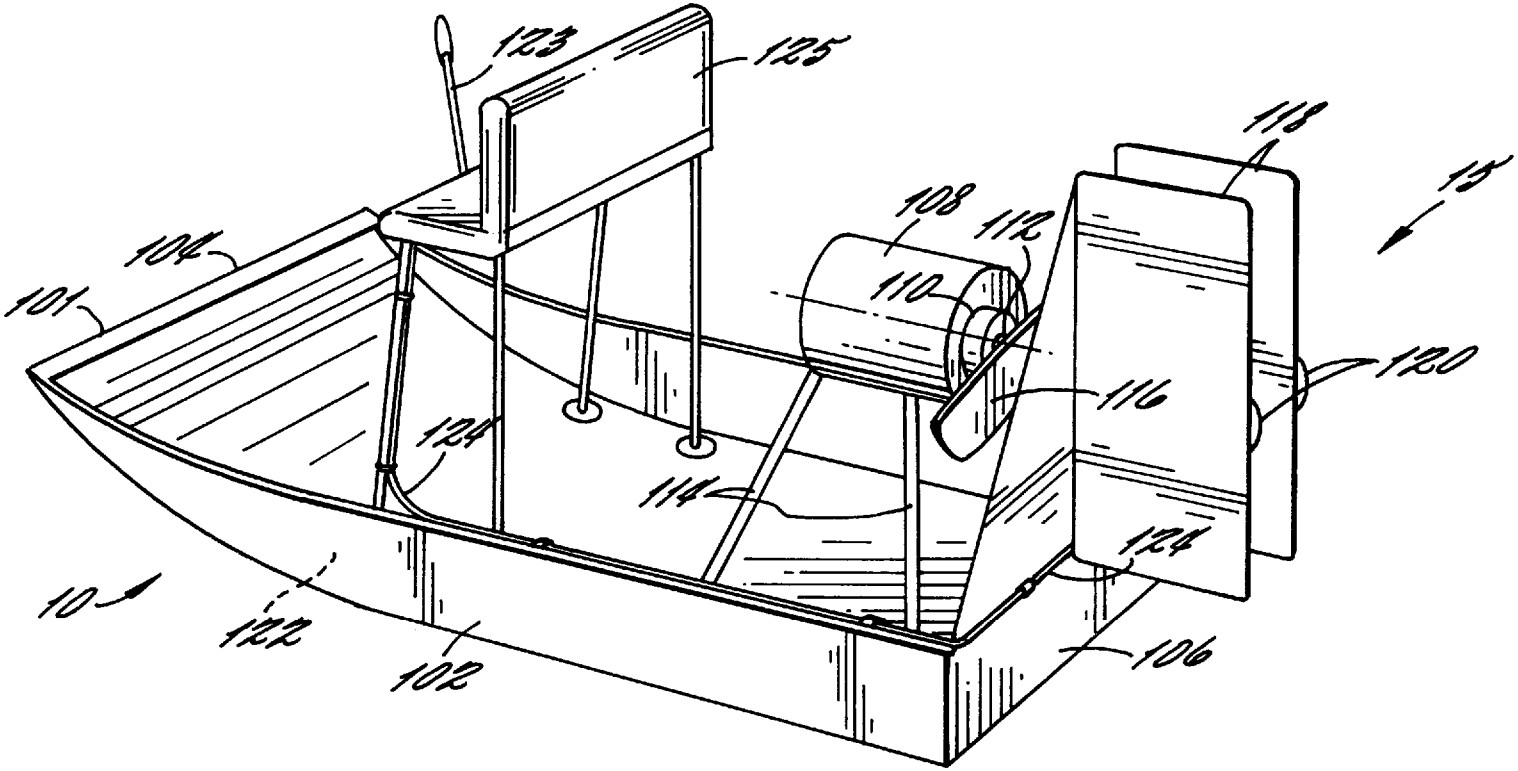
FIG. 1 is a schematic depiction of an airboat with a single propeller.

In FIG. 1 is shown an airboat 10 having a boat structure 104 with a bow 101, hull 122, gunwales 102, and stern 106. An engine 108 drives via transmission 110 a hollow driven shaft 112, upon which is mounted propeller 116. Typically, the engine 108 is an aircraft engine capable of operating at about 3000 rpm for sustained periods of time. Engine 108 is supported on mounting means 114, connected to the hull 122 of the boat structure 104. The mounting means 114 serve to raise engine 108, transmission 110, and hollow driven shaft 112 a sufficient distance that the propeller blade 116 clears the top of the stern 106; that is, the center of hollow driven shaft 112 must be positioned at least one-half the length of propeller blade 116 above the top of stern 106. Steering means 15 comprise rudders 118, trim tabs 120, which correct for torque caused by the turning of a single propeller blade, and steering manipulation means 124, operable from a joystick 123 at a forward position 125 remote from the steering means by an operator.

Figure 2:
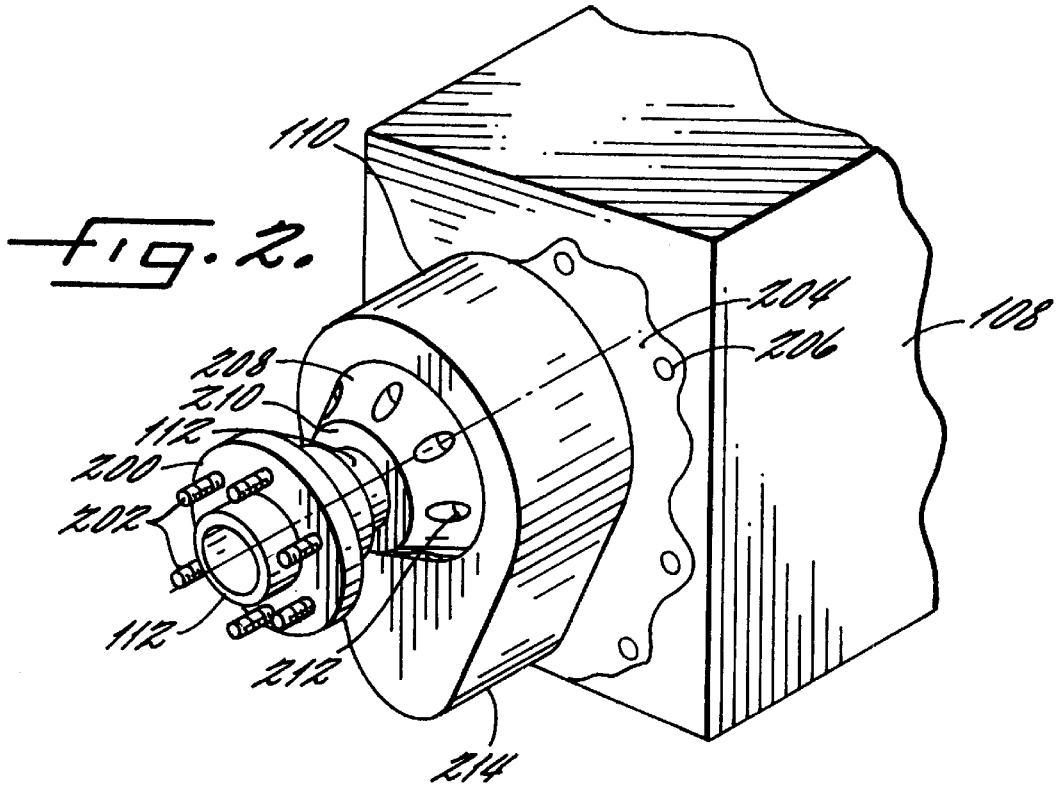
FIG. 2 is a perspective view of a transmission for an airboat with a single propeller, propeller mount, and hollow driven shaft.

In FIG. 2 is shown the transmission 110 for an airboat with a single propeller. The transmission 110 is mounted to engine 108 by way of bell housing 204 via bolts 206. A gear train in transmission 110 drives hollow driven shaft 112, to which is attached propeller mount 200, to whose protrusions 202, containing propeller dowels, a propeller is attached. Output hub 208 is attached to transmission housing 214 with bolts 212. Inside output hub 208 are tapered bearings which provide an added flexibility to the hollow driven shaft 112 and allow lateral movement when turning forces are applied to the shaft 112. The tapered shape of output hub 208 permits optimal air flow to the propeller 116. Oil seal 210 is positioned between output hub 208 and shaft 112.

Typically, the hollow driven shaft 112 is on the order of 10.125 inches long and with the width at the proximal end, which is bolted to and driven by transmission 110, on the order of 3.0 inches. Following several shoulders in the outer surface of shaft 112, the outer diameter typically decreases to 2.25 inches at the distal end. A threaded portion on the outer surface of shaft 112 couples to the gear train inside transmission 110. At the position at which propeller mount 200 is attached, a key slot is situated, and the propeller mount 200 is affixed against-a shoulder in the shaft (proximal to the propeller mount) having a diameter of 2.48 inches. The bore in shaft 112 typically tapers from about 1.88 inches at the proximal end to about 1.63 inches at the distal end.

The stress-strain properties of the steel used for the hollow driven shaft 112 and in the following two-shaft embodiment disclosed below with reference to FIGS. 3–9 are extremely important, owing to the flexibility required in airboat applications, as has been discussed. Therefore, a heat-treated and stress-relieved steel is preferred. By way of example, a tempered steel alloy denoted as 4150 28–30 RC is suitable.

The single-propeller embodiment discussed above thus provides a hollow driven shaft which offers flexibility and strength, improving operation lifetime owing to decreased failure rate, and decreased weight, improving efficiency. By way of example, a hollow driven shaft of the steel and dimensions noted above has been found to withstand a 180° turn at 45 MPH without catastrophic failure.

Airboat with Dual Propellers and Hollow Driven Shafts

The second embodiment to be discussed is an airboat containing a transmission with first and second gear trains, also called a counter-rotator, which drives coaxial proximal and distal propellers in opposite directions.

Figure 5:
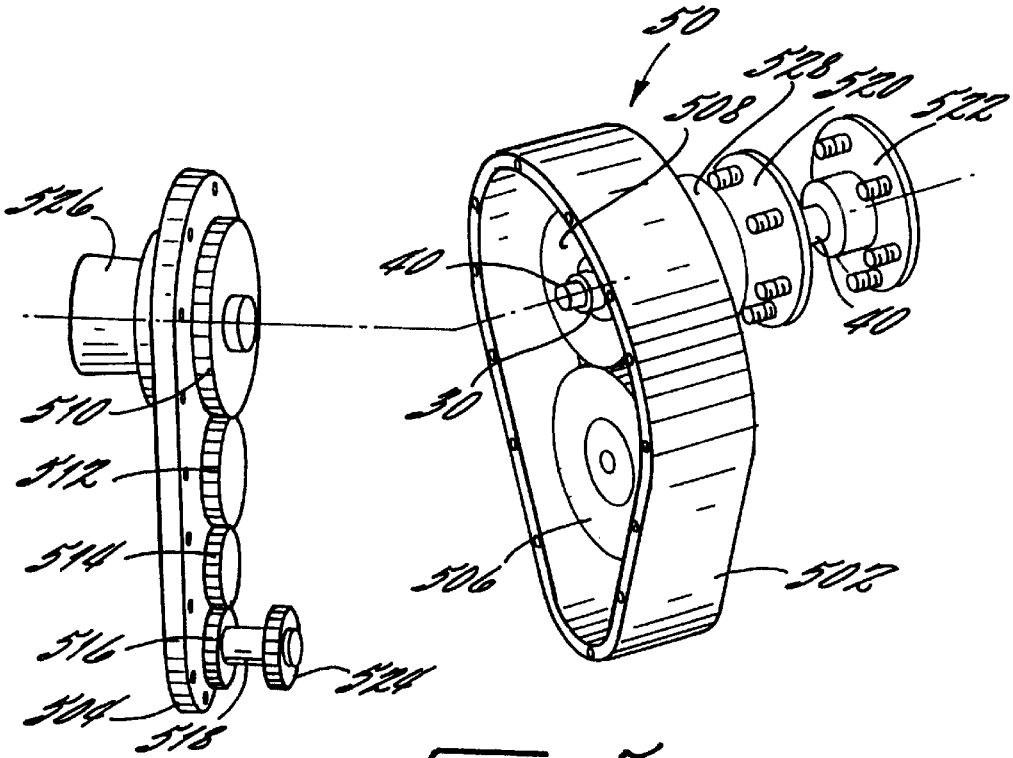
FIG. 5 is a perspective view of the interior of a transmission showing gear trains, the outer and inner hollow driven shafts of FIGS. 3 and 4, and both propeller mounts.
Figure 3:
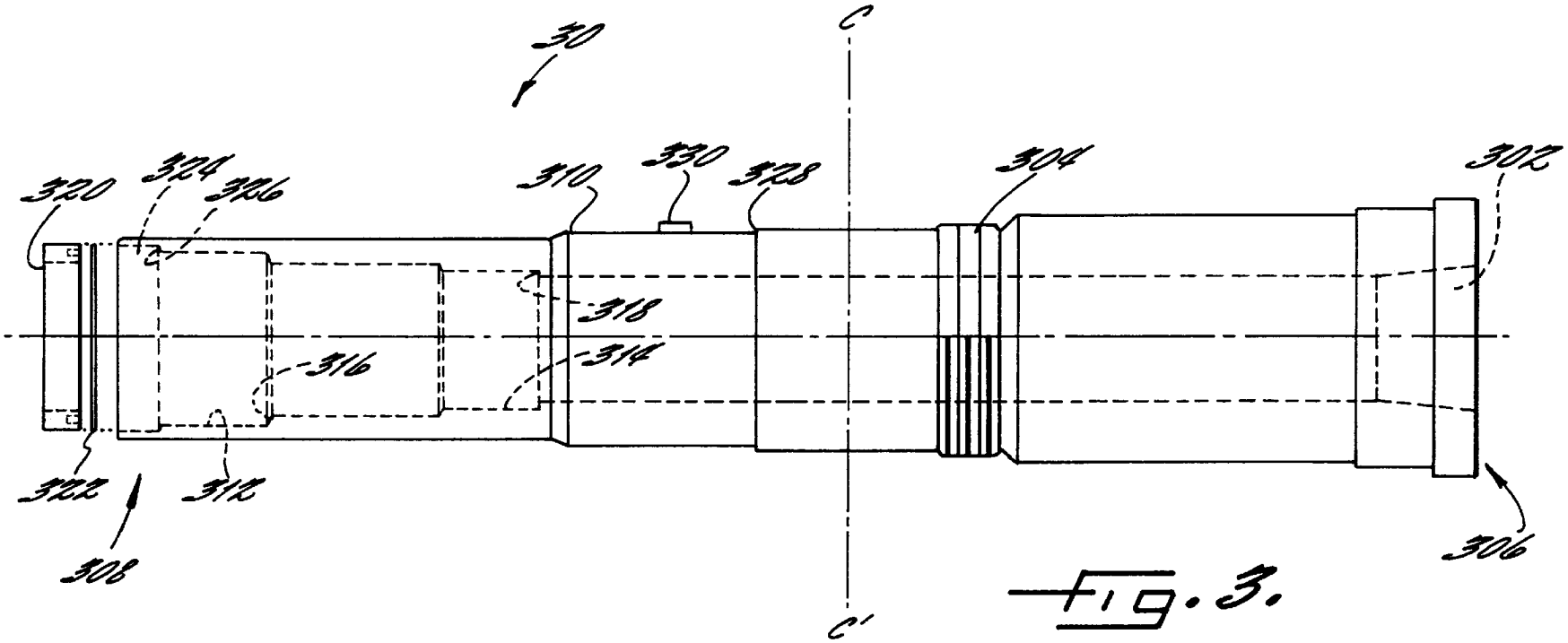
FIG. 3 is a side view of an outer hollow driven shaft useful in a coaxial drive system.
Figure 4:
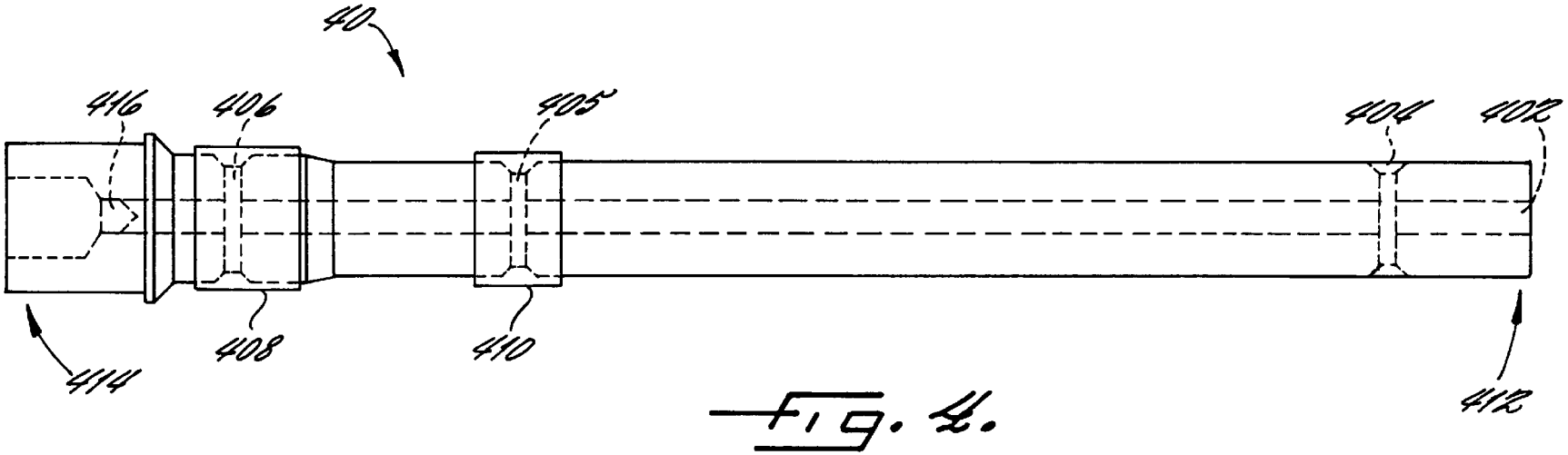
FIG. 4 is a side view of an inner hollow driven shaft useful in a coaxial drive system.

FIGS. 3–5 illustrate a first, outer hollow driven shaft 30 for use in an airboat having two propellers rotating in opposite directions. The first shaft 30 has a longitudinal bore 302 dimensioned to hold a second, longer hollow driven shaft 40 and stiffener bearings 408 and 410, which fit inside recesses 312 and 314, respectively, the bearings 408 and 410 positioned against the bore shoulders 316 and 318, respectively as shown in FIG. 5. Threaded portion 304 which connects the outer hollow driven shaft 30 at its proximal end 306 to the gearing means of the counter-rotator, as shown in FIG. 5. The position along shaft 30 at which the shaft enters the counter-rotator housing (502 on FIG. 5) is indicated by dotted line C–C' in FIG. 3. The propeller is affixed along straight portion 310 of the outer hollow driven shaft 30, against outer shoulder 328, with key 330, at which the shaft's diameter is on the order of 2.246 inches, in order to fit inside a standard propeller mount, whose inner diameter is almost universally a dimension of 2.25 inches. Seal 320 and washer 322 are affixed into the distal end 308 of outer shaft 30, into recess 324 against bore shoulder 326.

FIG. 4 illustrates the second, inner hollow driven shaft 40 having longitudinal bore 402, and a proximal end 412 with a spline for attachment to the gearing means in counter-rotator 50 (see FIG. 5). Circumferential holes 404, 405, and 406 in the second shaft 40 serve as part of the lubrication path, shown in more detail in FIG. 7. Floating stiffener bearings 408 and 410, shown in more detail in FIGS. 8 and 9, suppress flexion of the shafts 30, 40 and protect the inner surface of outer hollow driven shaft 30 from damage caused by abrasion from flexion of inner hollow driven shaft 40. At distal end 414 of inner shaft 40 is inserted plug 416 to block oil flow from bore 402 (see FIG. 7).

FIG. 5 shows the interior of the counter-rotator 50, including the gear trains. The exterior of counter-rotator 50 is formed by housing plate 504, secondary output hub 526, which contains an oil pump, counter-rotator housing body 502, and main output hub 528. As discussed for the single propeller system shown in FIG. 2, main output hub 528 contains bearings separated by a spacer for added flexibility. The hub 528 permits the shafts to be supported at a greater distance from housing, as shown by line C—C in FIG. 3. Also shown are the propeller mount 522, attached to inner hollow driven shaft 40, and propeller mount 520, attached to outer hollow driven shaft 30. The drive shaft from the engine is coupled to shaft 518, on which are gears 524 and 516. Gear 524 drives, in sequence, gears 506 and 508. Shaft 518, spaces off the first gear train, which drives outer hollow driven shaft 30, laterally from gear 516, which then drives a second gear train, comprising gears 514, 512, and 510. Gear 510 is coupled to inner driven shaft 40. The even number of direction-changing gears in the second gear train accomplishes counter-rotation from gear 516 to final gear 510; the odd number of direction-changing gears in the first gear train effects no change in initial direction from gear 524 to gear 508. Thus the hollow driven shafts 30 and 40 are rotated in opposite directions. It should be further noted that all gears, in the most preferred embodiment, in the first and second gear trains are helical gears, which ensures smoother, quieter action and better load capacity.

Figure 6:
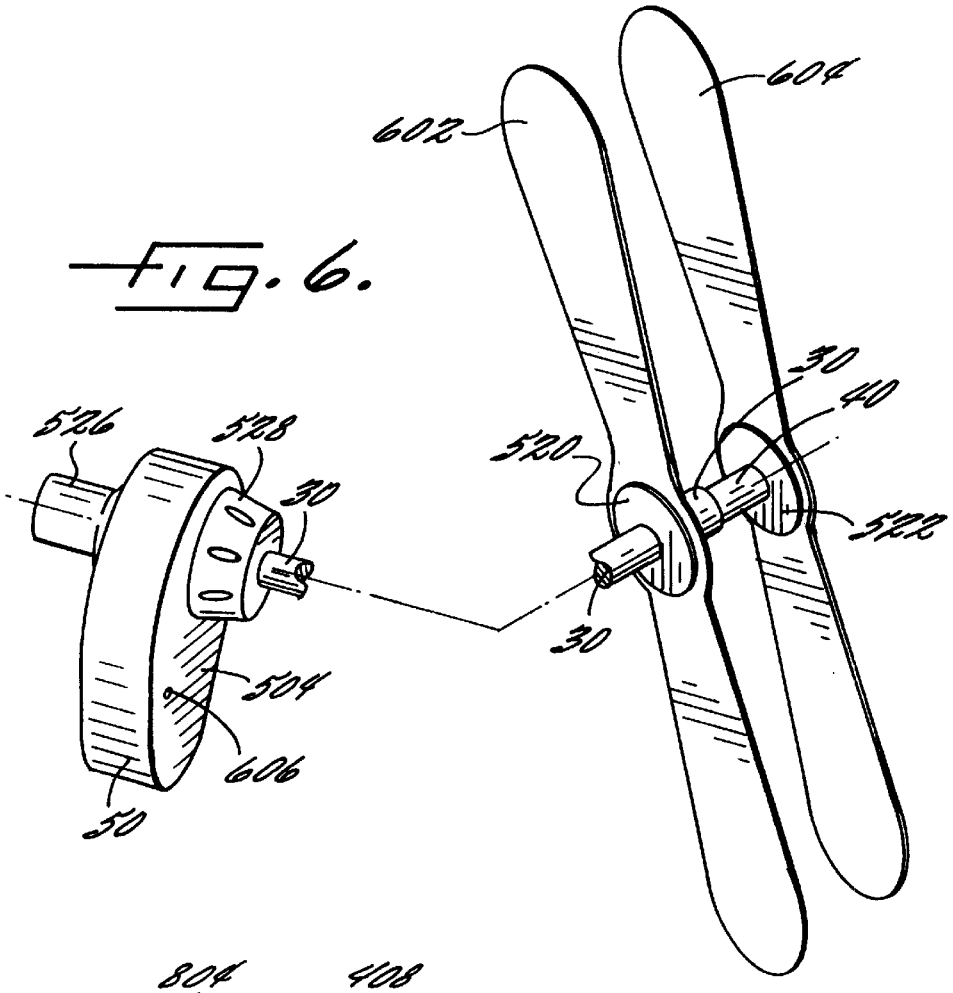
FIG. 6 shows a counter-rotator system for an airboat, using the transmission of FIG. 5 and the drive shafts of FIGS. 3 and 4.
Figure 10:
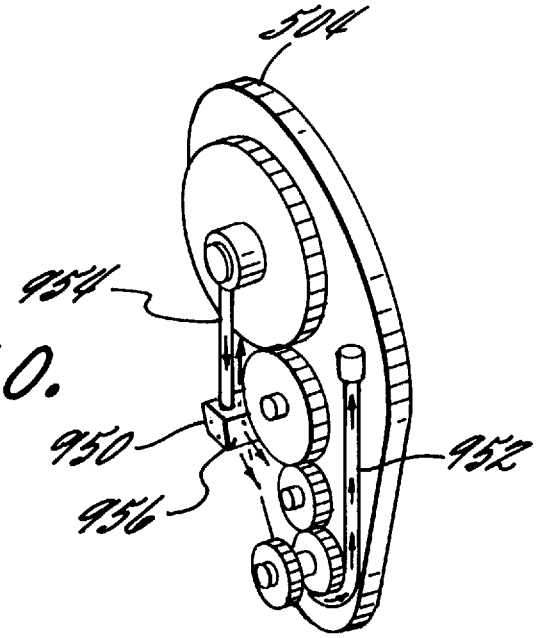
FIG. 10 is a perspective view of the transmission of FIG. 5, showing the path of lubricating oil.

FIG. 6 illustrates the combination of the counter-rotator 50 with outer hollow driven shaft 30, connected to propeller 602 via propeller mount 520, and with inner hollow driven shaft 40, connected to propeller 604 via propeller mount 522. Lubricating oil level is visualized through sight glass 606 in housing plate 504 in counter-rotator 50. (An illustration of the lubricating system within the counter-rotator is shown in FIG. 10.)

In a further embodiment, inner driven shaft 40 is driven 8–15% faster than outer driven shaft 30, which is accomplished by dimensioning the gears accordingly. This rotation difference increases the efficiency of the airboat system by permitting air turbulence "swirls" created by the proximal propeller 604 to be converted to useful forward thrust by propeller 602.

Figure 8:
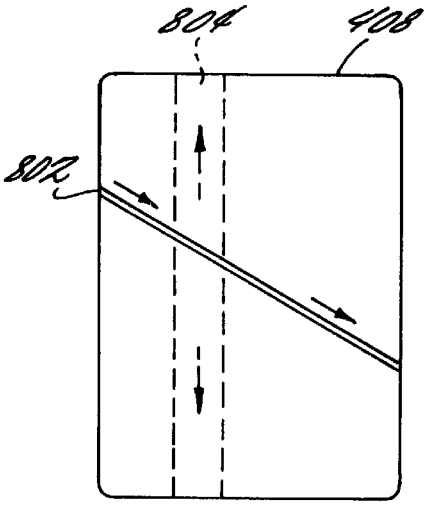
FIG. 8 is a side view of one of a first floating stiffener bearing of FIG. 7.
Figure 9:
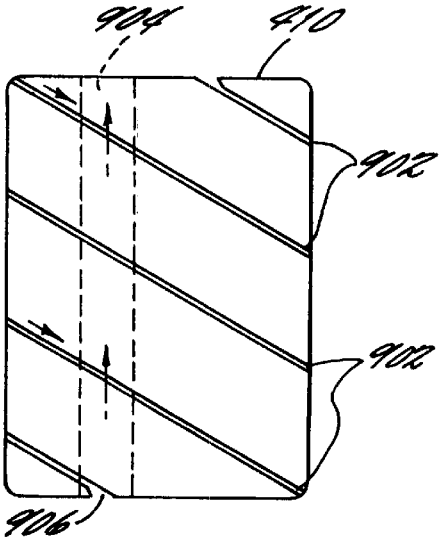
FIG. 9 is a side view of a second floating stiffener bearing of FIG. 7.
Figure 6:
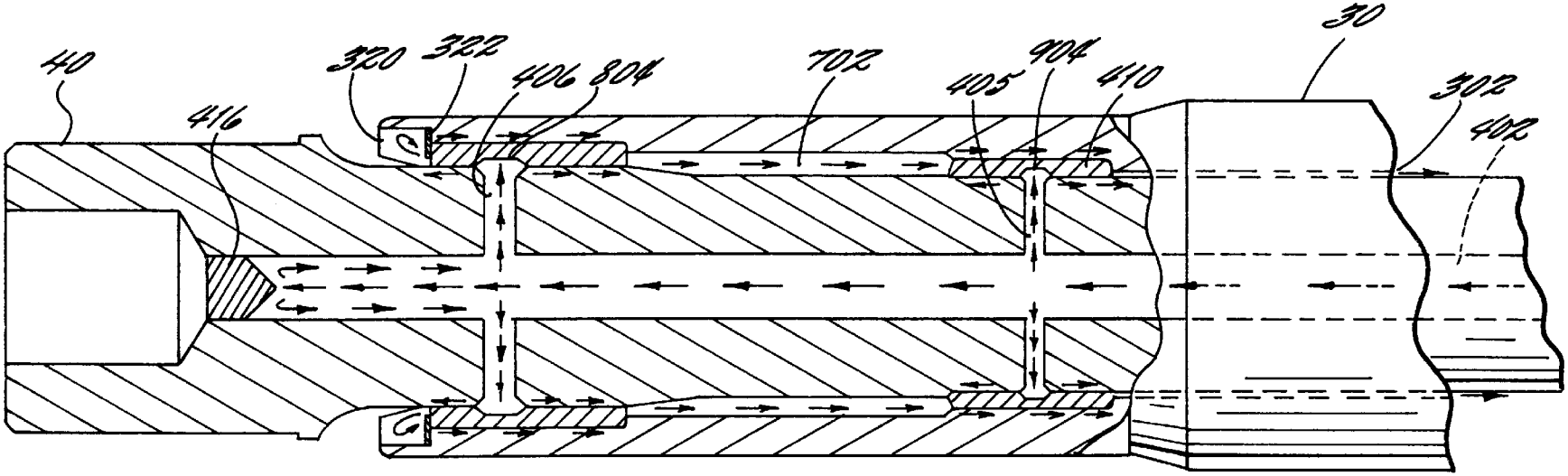

FIG. 7 is a longitudinally cross-sectional view of the combined outer 30 and inner 40 hollow driven shafts and first floating stiffener bearing 408 and second floating stiffener bearing 410. FIGS. 8 and 9 show details of the floating stiffener bearings 408 and 410, respectively, which are in the preferred embodiment made of bronze, in this example a bronze denoted as Aamco 660, a material chosen for its strength and flexibility. As is known in the art, bearing materials should be softer than the shaft materials, which is the case here. The assembly of these elements and the path of lubricating oil flow will be discussed with reference to FIGS. 7–9.

Inner hollow driven shaft 40 is inserted into the bore 302 of outer hollow driven shaft 30. Hollow cylindrical floating stiffener bearings 408 and 410 are positioned between the hollow driven shafts 30 and 40 as previously discussed. Further, inner circumferential grooves 804 and 904 in floating stiffener bearings 408 and 410 are situated to communicate with diametric holes 406 and 405, respectively, in the inner hollow driven shaft 40. First floating stiffener bearing 408 has two outer angled grooves 802, and second floating stiffener bearing 410 has seven outer angled grooves 902. These angled grooves are wider and deeper at the edges 906 to improve oil circulation properties. The second floating stiffener bearing 410 has a greater number of grooves than the first floating stiffener bearing 408, since it will be seen to be in the path of greater oil flow volume.

The lubrication of the shaft and bearing assembly will now be discussed. Oil pumping means provides lubricant, in the most preferred embodiment 80–90 weight multipurpose differential oil, at approximately 25 pounds per square inch pressure. Referring to the arrows in FIG. 7, oil enters through inner shaft bore 402, via diametric hole 404 (shown in FIG. 4), being stopped at plug 416 in bore 402. The two diametric holes 406 and 405 communicate with inner circumferential grooves 804 and 904 in floating stiffener bearings 408 and 410, respectively, wherefrom oil passes between the inner surfaces of the floating stiffener bearings 408 and 410 and the outer surface of inner shaft 40. The outer surfaces of floating stiffener bearings 408 and 410 are lubricated via angled grooves 802 and 902, respectively. The arrows in FIGS. 8 and 9 illustrate the oil flow path inside and outside the floating stiffener bearings 408 and 410. Oil escape from the distal end of outer shaft 30 is prevented by seal 320 and washer 322.

The path of returning oil flow proceeds between the inner surface of outer shaft 30 and the outer surfaces of floating stiffener bearing 408, floating stiffener bearing 410, and inner shaft 40.

The path of returning oil continues as shown in FIG. 10. Emerging from between hollow driven shafts 30 and 40, oil is collected in tube 954 and enters oil gallery block 950, which has pores 956. Through these pores 956 oil sprays onto the gear trains inside counter-rotator 50 and collects at the bottom of counter-rotator housing body 502, shown in FIG. 5. This collected oil is recirculated by being pumped out of counter-rotator housing body 502 through tube 952, back to the oil pumping means.

While the preceding discussion discloses the preferred embodiments of the present invention, it will be understood by those skilled in the art that other embodiments are possible.

What is claimed is:

1. An airboat construction, comprising:

a boat hull having a forward bow, an opposing aft stern and gunwales extending between the bow and the stern;

an engine supported by the hull between the gunwales, the engine including an aft-facing first end with a rotatable drive shaft extending from the first end in an aft direction toward the stern;

a transmission housing fitted directly to the first engine end, without any intervening spacers in order to withstand extreme gyroscopic forces, the transmission housing having a lower portion through which the engine drive shaft rotatably extends, the transmission housing also having an upper portion above the lower portion;

a propeller shaft having a first section extending through and rotatably supported by the upper portion of the transmission housing, and a second section extending away from the engine and aft toward the stern;

an assembly of multiple gears rotatably fitted within the transmission housing and mechanically coupled with the engine drive shaft and the propeller shaft for rotating the propeller shaft in response to rotation of the engine shaft; and a propeller fitted to the extremity of the second section of the propeller shaft.

2. The airboat construction recited in claim 1 further comprising means for permitting reductions in engine speed without loss of efficiency.

3. The airboat construction recited in claim 2 wherein the means for permitting reductions in engine speed without loss of efficiency comprises means for imparting a predetermined degree of flexibility to the propeller shaft.

4. The airboat construction recited in claim 3 wherein the flexibility-imparting means comprises a longitudinal hollow along a portion of the length of the propeller shaft.

5. The airboat construction recited in claim 4 further comprising a longitudinal reduction of the hollow from a larger cross-sectional width along the first section to a smaller cross-sectional width toward the second section.

6. The airboat construction recited in claim 5 further comprising a bearing rotatably supporting the propeller shaft through the transmission housing.

7. The airboat construction recited in claim 1 further comprising:

a second propeller;

means for mounting the second propeller with the propeller shaft; and means including the multiple gears for rotating the propellers in opposing directions.

8. The airboat construction recited in claim 1 wherein the transmission housing comprises:

a housing plate adapted for fitting with the first engine end;

a gear housing; and means for removably fitting the gear housing to a first side of the housing plate with the multiple gears therein.

9. The airboat construction recited in claim 8 wherein the means for removably fitting the gear housing comprises:

plural fastener holes extending through the periphery of the housing plate between the first side and a second side thereof;

plural fastener holes extending into the periphery of the gear housing facing the first side of the housing plate; and fastener means extending through the housing plate fastener holes and into the gear housing fastener holes to thereby firmly hold the gear housing against the first side of the housing plate.

10. The airboat construction recited in claim 1 further comprising a bearing rotatably supporting the propeller shaft extending through the transmission housing.

11. An airboat construction permitting reductions in engine speed without loss of efficiency, comprising:

a boat hull having a forward bow, an opposing aft stern and gunwales extending between the bow and the stern;

an engine supported by the hull between the gunwales, the engine including an aft-facing first end with a drive shaft extending from the first end in an aft direction toward the stern;

a transmission housing fitted to the first engine end, the transmission housing including a housing plate directly fitted with the first end of the engine, without any intervening spacers in order to withstand extreme gyroscopic forces, with the engine drive shaft extending through sand plate;

a propeller shaft having a first section extending through and rotatably supported by the transmission housing and a second section extending away from the engine and aft toward the stern;

multiple gears rotatably fitted within the transmission housing for rotating the propeller shaft in response to rotation of the engine shaft; and a propeller fitted to the extremity of the second section of the propeller shaft.

12. The airboat construction recited in claim 11 wherein the propeller shaft includes a longitudinal hollow which has a larger cross-sectional width at the first section and a smaller cross-sectional width toward the second section.

13. The airboat construction recited in claim 12 further comprising a bearing rotatably supporting the propeller shaft in the transmission housing.

14. The airboat construction recited in claim 11 wherein the transmission housing includes a lower portion into which the engine shaft extends and an upper portion vertically above the lower portion into which the propeller shaft extends.

15. The airboat construction recited in claim 11 further comprising bolt means for rigidly fixing the transmission housing directly to the first end of the engine without any intervening spacers.

* * * * *